United States Patent [19]

Spencer

[11] 4,097,681

[45] Jun. 27, 1978

[54] INTERFACE FOR HIGH VOLTAGE OIL-FILLED AND GAS-FILLED APPARATUS

[75] Inventor: Edward M. Spencer, Mississauga, Canada

[73] Assignee: I-T-E Industries Ltd., Mississauga, Canada

[21] Appl. No.: 763,833

[22] Filed: Jan. 31, 1977

[51] Int. Cl.[2] ..... H01F 27/04; H01B 17/26

[52] U.S. Cl. ..... 174/12 R; 174/18; 174/22 R; 361/332

[58] Field of Search ..... 174/11 R, 11 BH, 12 R, 174/12 BH, 14 R, 14 BH, 18, 21 R, 21 C, 22 R, 22 C, 23 R, 31 R; 361/332

[56] References Cited

U.S. PATENT DOCUMENTS

| | | | |
|---|---|---|---|
| 3,643,003 | 2/1972 | Graybill | 174/18 |
| 3,746,935 | 7/1973 | Wagenaar et al. | 174/18 X |
| 3,819,845 | 6/1974 | Tahiliani | 174/18 X |

FOREIGN PATENT DOCUMENTS

| | | | |
|---|---|---|---|
| 273,076 | 6/1927 | United Kingdom | 174/18 |

*Primary Examiner*—Laramie E. Askin
*Attorney, Agent, or Firm*—Ostrolenk, Faber, Gerb & Soffen

[57] ABSTRACT

Gas-insulated electrical apparatus is connected to oil-insulated electrical apparatus within an intermediate oil-filled tank having an oil pressure lower than the pressure within the oil-insulated apparatus. If gas leaks into the relatively low pressure oil, the gas contaminated oil cannot leak into the oil-insulated equipment. The intermediate oil-filled tank has larger electrical clearances than the oil-insulated apparatus.

6 Claims, 2 Drawing Figures

53
54
50
51
52
19
15
16
14
17
40
30
18
56
31
22
20
21
13
32
12
11
41
10
55
OIL INSULATED TRANSFORMER

INTERFACE FOR HIGH VOLTAGE OIL-FILLED AND GAS-FILLED APPARATUS

BACKGROUND OF THE INVENTION

This invention relates to high voltage electrical apparatus, and more specifically relates to a novel interface for connecting gas-insulated electrical apparatus to oil-insulated electrical apparatus.

High voltage electric power installations are well known where these installations may be insulated by gas and include oil-filled equipment. For example, high voltage gas-insulated substations and transmission lines are well known, wherein high voltage conductors and components are insulated from other components and from grounded enclosures by a gas, such as sulfur hexafluoride, under about 45 p.s.i.g. Gas-insulated substations of this type are commonly associated with high voltage oil-filed transformers, and means must be provided for making electrical connection between the gas-insulated conductors or components of the gas-insulated substation and the oil transformer bushings. Considerable care must be taken in these connections since the leakage of gas into the oil insulated apparatus could cause a breakdown of the oil-insulated apparatus.

SUMMARY OF THE PRESENT INVENTION

In accordance with the present invention, a novel interface is provided for electrically connecting gas-insulated equipment to oil-insulated equipment which includes an intermediate oil-filled chamber which is at a pressure less then the pressure of the oil within the oil-filled apparatus. In carrying out the invention, a gas-filled bushing, connected to the gas-filled equipment, extends into the intermediate oil-filled chamber and, similarly, an oil-filled bushing extends from the oil-insulated equipment and into the intermediate chamber. An electrical connection is then made within the intermediate chamber.

Two conservator tanks are then provided, one for the oil-insulated equipment and the other for the intermediate oil-filled chamber, where the conservator for the intermediate oil-filled chamber is vertically lower than the conservator for the oil-insulated equipment, whereby the pressure of the oil-insulated equipment is higher than the pressure of the intermediate oil-filled chamber. Consequently, if gas, such as sulfur hexafluoride, should leak from the gas-insulated bushing into the oil within the intermediate chamber, the contaminated oil cannot find its way into the higher oil pressure of the oil-insulated equipment. That is, if there is any leak between the oil bushing or oil-filled transformer, the oil leak will flow out of the oil bushing or apparatus and into the intermediate chamber. The intermediate chamber dimensions are then made large enough that there will be no breakdown due to gas-contaminated oil.

Clearly, any desired means can be provided for providing a differential pressure between the intermediate chamber and the oil-insulated equipment.

DETAILED DESCRIPTION OF THE DRAWINGS

Figure 1:
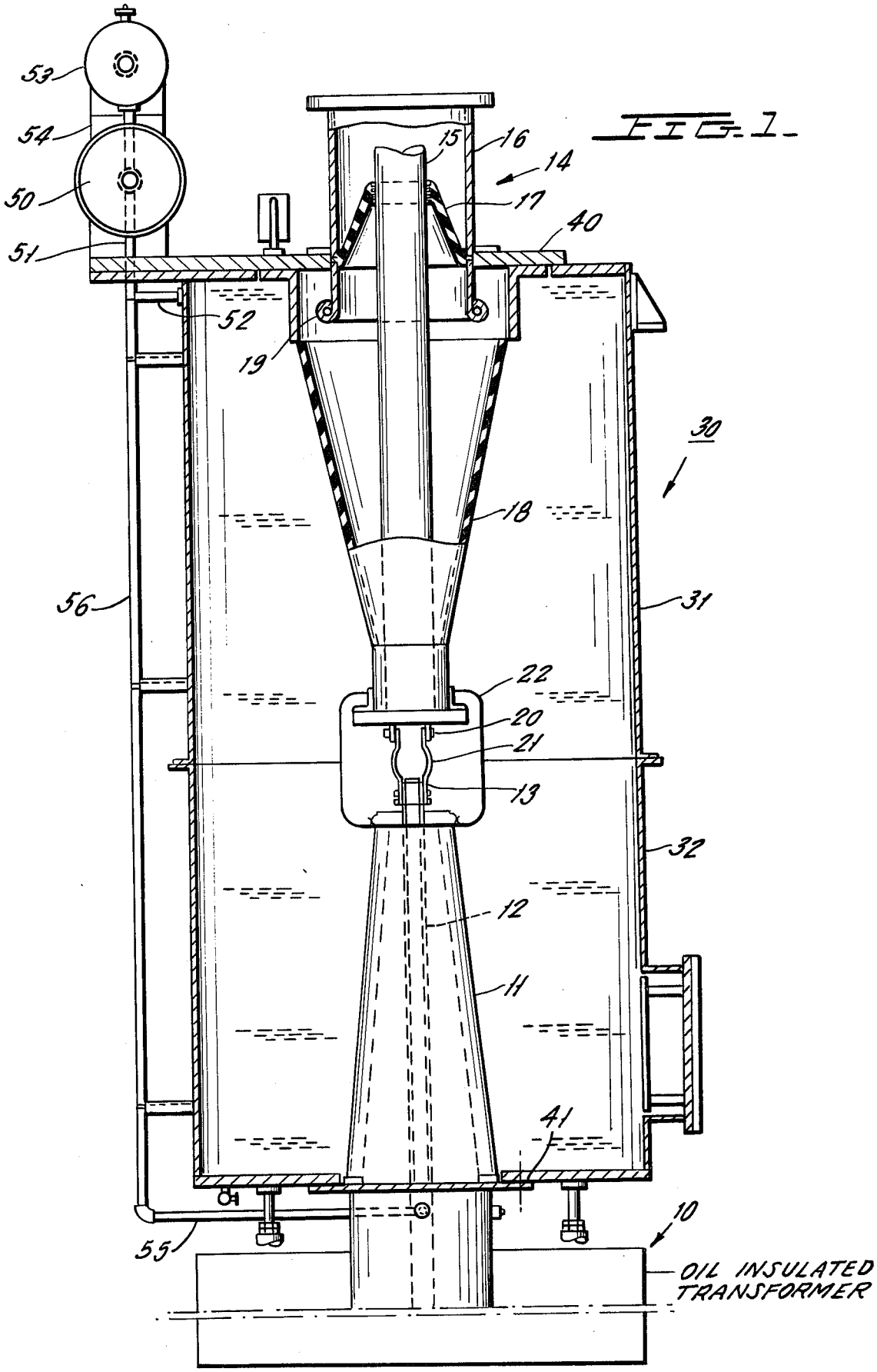
FIG. 1 is a schematic elevational view of an oil-filled transformer connected to a gas-insulated bus through an intermediate interface chamber in accordance with the invention.
Figure 2:
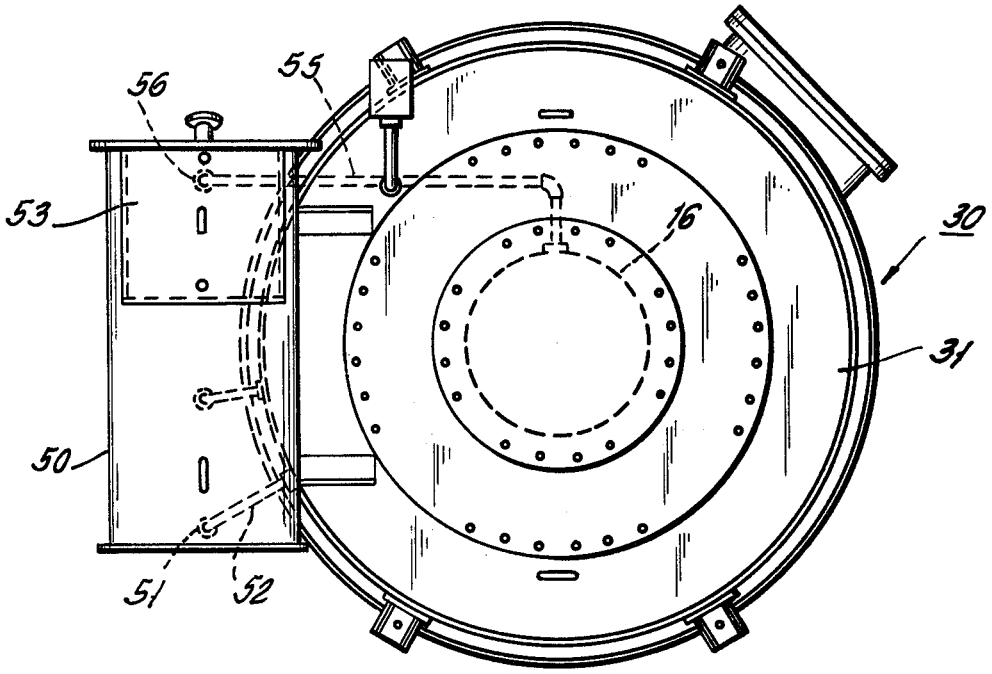
FIG. 2 is a top view of FIG. 1.

Referring now to FIGS. 1 and 2, there is shown a typical arrangement whereby an oil-insulated high voltage transformer 10 (only a single phase is schematically illustrated) has an oil-filled bushing 11 extending therefrom which carries an insulated central conductor 12 to a bushing terminal 13. The oil-insulated transformer 10 is to be connected to a gas-insulated bus 14 which may be of any conventional type and contains a central conductor 16 supported within a grounded metallic housing 16 by support insulators, such as the conical support insulator 17. The interior of housing 16 is then filled with sulfur hexafluoride at a pressure, for example, of 45 p.s.i.g. to insulate the central conductor 15 from the outer housing 16.

A suitable $SF_6$ filled bushing 18 is then connected to the bus 14 and the bushing may have the structure shown in U.S. Pat. No. 3,643,003 dated Feb. 15, 1972, in the name of Howard W. Graybill. Note that outer housing 16 terminates within the gas-filled bushing 18 by a corona ring 19. The gas-filled bushing 18 then has an exterior bushing terminal 20. The bushing terminal 20 is then connected to the bushing terminal 13 of the oil bushing 11 by suitable conductive straps 21 and the connection may be enclosed by a conventional corona shield 22.

Further in accordance with the present invention, the oil bushing 11 is connected to the gas bushing 18 within a chamber 30 formed between chamber halves 31 and 32. Note that the gas-filled bus 14 is connected to the upper end of chamber half 31 and is suitably sealed to end 40 of chamber half 31. Similarly, the oil bushing 11 is connected to and sealed to the bottom end 41 of chamber half 32. The chamber 30, formed between halves 31 and 32, is then completely filled with electrical grade oil which may be of the same type used in the oil-insulated transformer 10 and bushing 11. However, the oil within chamber 30 is kept at a pressure lower than the pressure within the bushing 11 and transformer 10 so that oil cannot leak from the chamber 30 into the bushing 11 or transformer 10.

A preferred source of differential pressure between the interior of bushing 11 and chamber 30 can be obtained by suitably locating the conservator or storage tanks for the bushing 11 and the intermediate chamber 30. Thus, a first relatively large oil conservator chamber 50 is provided above the chamber 30 and is connected to the chamber 30 by conduits 51 and 52. A second conservator chamber 53, which contains oil, is mounted above chamber 50 and on the bracket 54 extending from chamber 50 and the higher conservator chamber 53 is connected to the oil-filled interior of bushing 11 by the conduits 55 and 56. Since conservator chamber 53 is located vertically above conservator chamber 50, the oil pressure within bushing 11 will be higher than the oil pressure within intermediate chamber 30. Therefore, if a leak should occur in the bushing 18 and gas leaks into chamber 30, the gascontaminated oil in chamber 30 will not leak into the bushing 11 since any oil leak in bushing 11 or apparatus 10 will always flow from the bushing 11 or apparatus 10 and into chamber 30, rather than the reverse.

The chamber 30 is then constructed to have sufficient internal clearance between the corona shield 22 to its grounded walls such that the pressure of gas in the oil within chamber 30 will not cause breakdown within chamber 30.

In the foregoing, the invention is described in connection with a single phase. Each phase of the system can have its own intermediate chamber arrangement as shown for the single phase disclosed.

Although a preferred embodiment of this invention has been described, many variations and modifications will now be apparent to those skilled in the art, and it is therefore preferred that the instant invention be limited not by the specific disclosure herein but only by the appended claims.

The embodiments of the invention in which an exclusive privilege or property is claimed are defined as follows:

1. Apparatus for connecting a gas-insulated high-voltage conductor to oil-insulated electrical apparatus; said gas-insulated high-voltage conductor comprising a central conductor suspended within a gas-filled elongated grounded housing; said oil-insulated apparatus comprising electrical apparatus disposed within a grounded oil-filled housing; said connecting apparatus comprising an intermediate oil-filled housing, an oil-filled bushing connected to said electrical apparatus and extending through said grounded oil-filled housing and into said intermediate housing, and a sealed gas-filled bushing connected to said central conductor and extending into said intermediate oil-filled housing; the conductors of said oil-filled bushing and of said gas-filled bushing being connected together within said intermediate housing; and pressure differential means for maintaining the oil pressure within said grounded oil-filled housing greater than the oil pressure within said intermediate housing, whereby gas which escapes into said oil in said intermediate housing will not leak into said grounded oil-filled housing.

2. The apparatus of claim 1 wherein said intermediate housing is disposed vertically above said grounded oil-filled housing.

3. The apparatus of claim 2 wherein said gas-insulated conductor is disposed vertically above said intermediate housing.

4. The apparatus of claim 3 wherein said pressure differential means includes a first oil conservator chamber hydraulically connected to said intermediate housing and a second oil conservator chamber hydraulically connected to said grounded oil-filled housing; said second chamber being disposed vertically above said first chamber.

5. The apparatus of claim 1 wherein said pressure differential means includes a first oil conservator chamber hydraulically connected to said intermediate housing and a second oil conservator chamber hydraulically connected to said grounded oil-filled housing; said second chamber being disposed vertically above said first chamber.

6. The apparatus of claim 5 wherein said intermediate housing is disposed vertically above said grounded oil-filled housing.

* * * * *